US007488092B2

(12) United States Patent
Mier-Langner et al.

(10) Patent No.: US 7,488,092 B2
(45) Date of Patent: Feb. 10, 2009

(54) TRACK FIXTURE WITH HINGED ACCESSORY RING

(75) Inventors: Alejandro Mier-Langner, Providence, RI (US); James E. Kuchar, Fall River, MA (US); Andrew E. Medeiros, Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 533 days.

(21) Appl. No.: 11/198,743

(22) Filed: Aug. 5, 2005

(65) Prior Publication Data

US 2007/0029456 A1 Feb. 8, 2007

(51) Int. Cl.
*F21V 19/02* (2006.01)

(52) U.S. Cl. ..... 362/285; 362/147; 362/287; 362/368; 362/404; 362/647; 362/648; 439/110; 439/122; 439/287

(58) Field of Classification Search ..... 362/147, 362/285, 287, 368, 404, 647, 648; 439/110, 439/122, 287
See application file for complete search history.

(56) References Cited

U.S. PATENT DOCUMENTS

| | | | |
|---|---|---|---|
| 1,654,873 | A | 1/1928 | Greenewalt |
| 1,773,524 | A | 8/1930 | Doyle |
| 1,830,355 | A | 11/1931 | Farr |
| 2,220,220 | A | 11/1940 | Cusimano |
| 2,301,419 | A | 11/1942 | Lew |
| 2,659,038 | A | 11/1953 | Heyer |
| 2,967,230 | A | 1/1961 | Goetz et al. |
| 3,011,388 | A | 12/1961 | Baumbach et al. |
| 3,083,293 | A | 3/1963 | Fandrey |
| 3,130,949 | A | 4/1964 | Erhardt et al. |
| 3,246,135 | A | 4/1966 | Husby |
| 3,303,336 | A | 2/1967 | Husby |
| 3,308,872 | A | 3/1967 | Smith |
| 3,338,132 | A | 8/1967 | Ruhle et al. |
| 3,484,599 | A | 12/1969 | Little |
| 3,492,070 | A | 1/1970 | Zahn |
| 3,721,817 | A | 3/1973 | Contratto |
| 3,818,216 | A | 6/1974 | Larraburu |
| 3,883,243 | A | 5/1975 | Weisglass et al. |
| 4,037,097 | A | 7/1977 | Stillman et al. |
| 4,066,884 | A | 1/1978 | Taylor |
| 4,104,707 | A | 8/1978 | Schneider |
| 4,175,279 | A | 11/1979 | Asaki |

(Continued)

FOREIGN PATENT DOCUMENTS

| | | |
|---|---|---|
| DE | 3622109 | 1/1988 |

(Continued)

*Primary Examiner*—Sandra L. O'Shea
*Assistant Examiner*—Meghan K. Dunwiddie
(74) *Attorney, Agent, or Firm*—John F. Salazar; Middleton Reutlinger

(57) ABSTRACT

The track fixture described has an accessory ring hingedly attached to the main portion of the track fixture luminaire. The hinge interposed between the accessory ring and the support ring or luminaire housing allows for both rotational and outward movement such that the accessory ring may be moved outward and away from the lamp and rotate about the support ring without interference between the accessory ring and the support ring or luminaire housing. The two movement hinge design is compact and allows for a clean outer appearance of the track fixture luminaire.

21 Claims, 6 Drawing Sheets

U.S. PATENT DOCUMENTS

| | | | |
|---|---|---|---|
| 4,233,651 | A | 11/1980 | Fabbri |
| 4,236,194 | A | 11/1980 | Norman |
| 4,242,723 | A | 12/1980 | Fabbri et al. |
| 4,323,955 | A | 4/1982 | Mark |
| 4,333,127 | A | 6/1982 | Alkema et al. |
| 4,380,792 | A | 4/1983 | Terrell |
| 4,392,187 | A | 7/1983 | Bornhorst |
| 4,591,955 | A | 5/1986 | Kallay |
| 4,602,321 | A | 7/1986 | Bornhorst |
| 4,618,918 | A | 10/1986 | Zhabokrug |
| 4,636,924 | A | 1/1987 | Targetti |
| 4,727,460 | A | 2/1988 | Payne |
| 4,775,918 | A | 10/1988 | Snyder |
| 4,800,474 | A | 1/1989 | Bornhorst |
| 4,843,528 | A | 6/1989 | Pearce-Harvey et al. |
| 4,887,196 | A | 12/1989 | Brown et al. |
| 4,931,917 | A | 6/1990 | Scherf et al. |
| 4,972,306 | A | 11/1990 | Bornhorst |
| 5,140,507 | A | 8/1992 | Harwood |
| 5,325,281 | A | 6/1994 | Harwood |
| 5,404,297 | A | 4/1995 | Birk et al. |
| 5,707,143 | A | 1/1998 | Hentz |
| 5,964,522 | A | 10/1999 | Schaefer et al. |
| 6,022,130 | A | 2/2000 | Donato |
| 6,152,583 | A | 11/2000 | Langner |
| 6,176,599 | B1 | 1/2001 | Farzen |
| 6,375,338 | B1 | 4/2002 | Cummings et al. |
| 6,447,145 | B1 | 9/2002 | Thomas et al. |
| 6,585,389 | B2 | 7/2003 | Bonazzi |
| 6,652,124 | B2 | 11/2003 | Schubert et al. |
| 6,702,454 | B2 | 3/2004 | Grajetzky et al. |
| 6,871,983 | B2 | 3/2005 | Jacob et al. |
| 7,175,300 | B1 * | 2/2007 | Medeiros ..... 362/217 |

FOREIGN PATENT DOCUMENTS

| | | |
|---|---|---|
| DE | 19829997 | 11/1999 |
| EP | 0908668 | 4/1999 |
| GB | 2325728 | 12/1998 |
| GB | 2345125 | 6/2000 |
| GB | 2348603 | 10/2000 |

* cited by examiner

TRACK FIXTURE WITH HINGED ACCESSORY RING

TECHNICAL FIELD

The present invention relates to track lights and particularly to PAR ring track lights which have accessory rings.

DETAILED DESCRIPTION OF THE PREFERRED EMBODIMENTS

Figure 1:
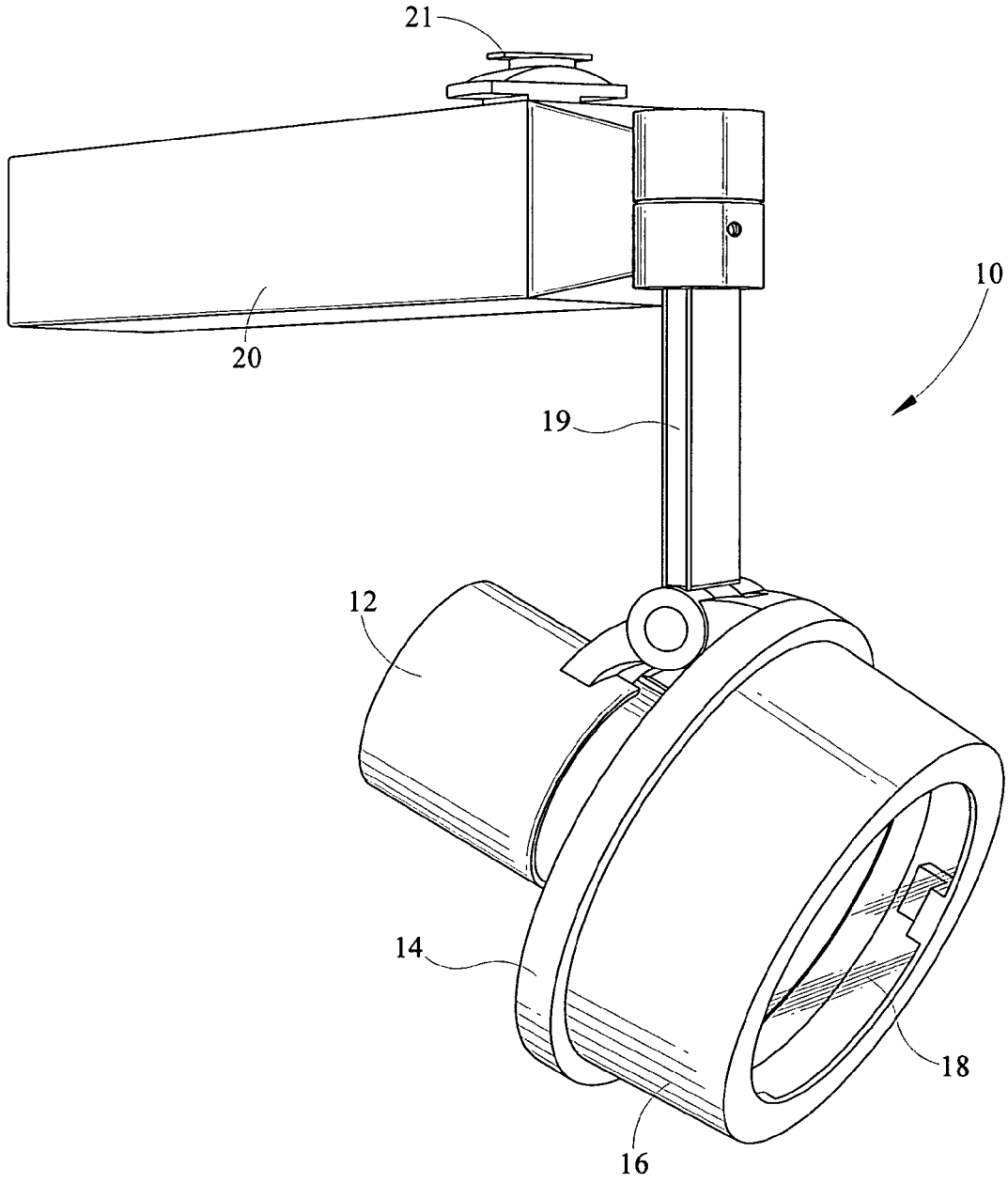
FIG. 1 is a perspective view of the track fixture with hinged accessory ring of the present invention.

The track fixture with hinged accessory ring 10 of the present invention is depicted generally in FIG. 1. As disclosed therein, the track fixture may typically be a PAR ring fixture wherein the track fixture is connected to an energized track via the track connector 21. As in most track fixtures with PAR lamps, the track, not shown, may be at line voltage wherein the power supply is modified by a transformer or ballast 20. The track fixture with hinged accessory ring 10 of the present invention, as is disclosed in FIG. 1, allows for a small clean exterior of the luminaire housing while also allowing for an accessory cartridge which is hingedly removable from the luminaire in order to provide access to the accessory cartridge as well as to the lamp.

As is understood, an accessory cartridge ring 16, as is depicted in FIG. 1, can be provided in order to install various lens or filters to the track fixture. It is often desirable therefore to provide relative easy access to the interior of the accessory cartridge or accessory ring 16 without necessitating complete removal of the ring. In such a design however, where hinged connection between the accessory ring and the remainder of the luminaire housing is desired, a hinge is typically provided on the exterior of the housing that allows for rotational movement between both the accessory ring 16 and the remaining portions of the luminaire housing or support ring. In such a hinged design, the hinge is typically on an exterior portion of the luminaire housing in order to provide adequate rotational clearance of the accessory ring away from the support ring and around the protruding lamp which is accomplished by increasing the size of the ring. Thus, as has also been done, the accessory ring may be completely removable without a hinged connection to the remaining portion of the luminaire. Such a completely removable accessory ring provides problems however, in the potential loss of the accessory ring or accessory set up during servicing of the luminaire.

In the track luminaire 10 of the present designed, the accessory ring 16 may be utilized to maintain a lens 18 or other accessories which may be provided adjacent to the lamp. As is depicted in FIG. 1 and the remaining figures, the accessory ring 16 of the present design does not necessarily require an external hinge mechanism allowing rotational movement between the accessory ring and the support ring 14. Further, with the hinge 26 of the present invention, it is allowable for the accessory ring 16 to be pulled outward and away from the support ring 14 in order to provide adequate clearance of the rotational movement of the accessory ring 16 about the lamp, shown in FIG. 3, while also maintaining a connectivity between the accessory ring 16 and the remaining portion of the luminaire, in the present embodiment, directly to the support ring 14. Thus, as shown in FIG. 2, the accessory ring 16 may be pulled outward away from support ring 14 in a outward movement so as to provide adequate clearance for rotational movement of the accessory ring 16 about a hinge pin 38.

As shown in the embodiment depicted in the figures, a socket cup 12 is connected to the support ring 14 and thereby to the accessory ring 16 by virtue of an arc shaped support arm having a hinge 22 allowing rotational movement of the luminaire. However, this design is merely exemplary only and a continuous housing may be provided between the support ring and the socket cup 12 thereby allowing the accessory ring 16 to be movable relative to an outer peripheral edge of the combined support ring and socket cup in both the outward movement and a rotational movement given the hinge design of the present invention. Such design modifications however, are considered to fall within the teachings of the present embodiment and disclosure hereof.

Returning to FIG. 1 and FIG. 2, a track connector 21 provides electrical connectivity to a track lighting system, not shown, wherein the transformer or ballast 20 is connected electrically to the socket cup by electrical connection through blade arm or support arm 19. The track luminaire 10 of the present invention may rotate about a vertical axis relative to the transformer or ballast and may also rotate about a horizontal axis relative to the blade arm 19 via hinge 22 depicted in FIG. 2. The PAR track fixture depicted in combination with the lamp shown in FIG. 3, allows for an accessory ring 16 which may contain filters, lens and other light modification mechanisms, to be pulled outwardly and away from the lamp in order to provide adequate rotational clearance of the lamp by the accessory ring 16.

Figure 2:
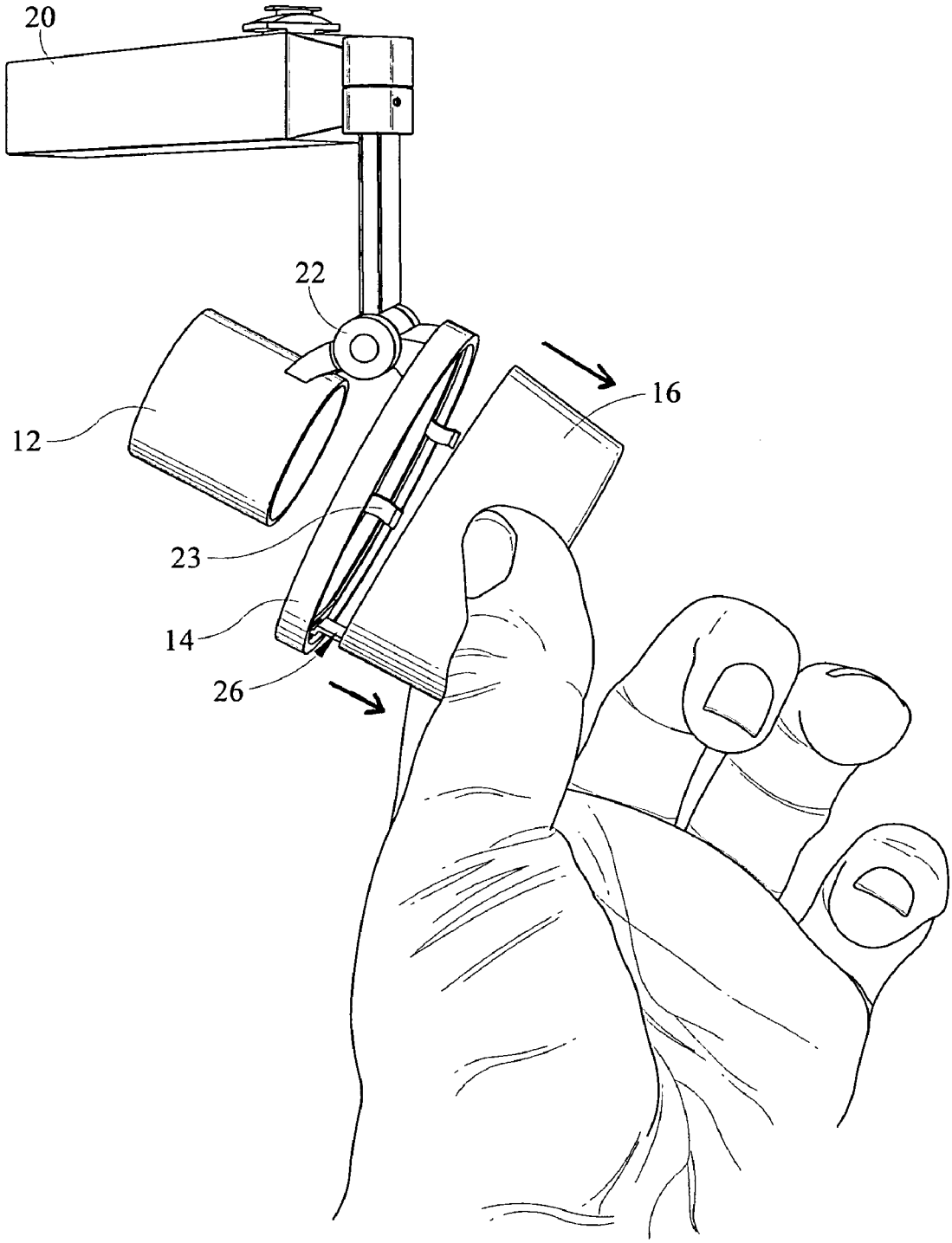
FIG. 2 is a perspective view of the track fixture of the present invention with the accessory ring pulled away from the fixture.

In the present example depicted in FIG. 2, the accessory ring 16 is maintained in position relative to the support ring 14 via retention clasps 23, retention clasps 23 being outwardly deformable to provide compressive resistance against retention edges 29 which are in co-alignment with retention clasps 23. Thus, the outward bias of the retention clasps 23 lock the clasps 23 in position behind a retention edge 29 while still allowing for outward movement of the accessory ring 16 from the support ring 14. Retention clasps 23, extends outwardly from retention spring 35, shown in FIG. 6, which may be removably retained in the support ring 14. As can understood, the retention spring 35 has an outward bias and may be generally C-shaped. The support ring 14 has a slight recessed channel 17 for receiving the retention spring 35 for secure placement of the spring 35 into the support ring 14. Thus, the retention spring 35 may be removably retained within the support ring 14 by flexing inwardly to remove the spring 35 from the annular recess 17.

Figure 5:
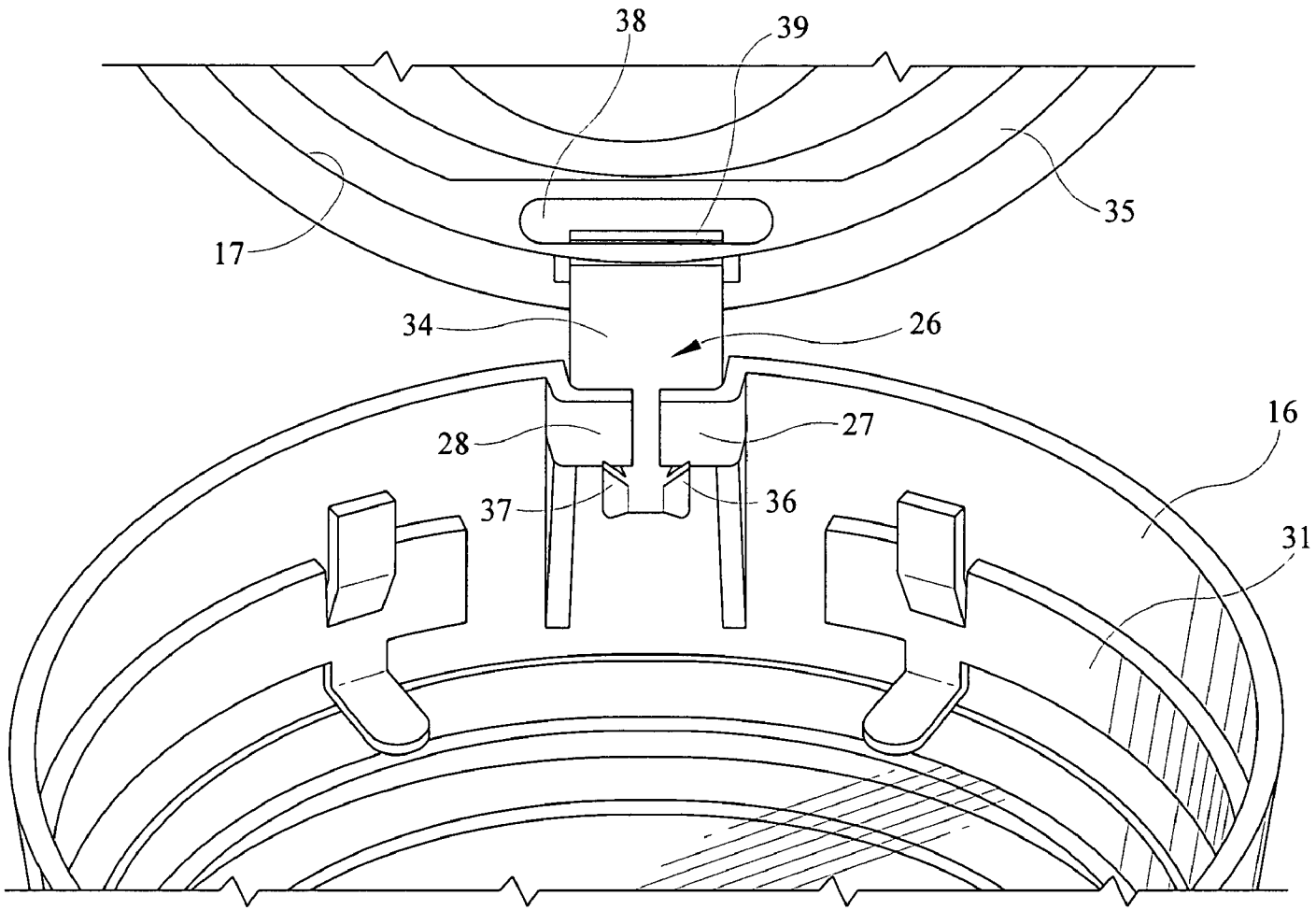
FIG. 5 is a frontal view of the pull out hinge of the present invention.

The retention spring 35 has along a lower edge a hinge pin 38, shown more clearly in FIG. 5, which is captured within a hinge capture 39 formed on hinge 26. The retention spring 35 held in the support ring 14 serves to removably retain the accessory ring 16 in adjacent alignment with the support ring 14 by virtue of the outward biasing effect of the retention clasps 23 against the retention edges 29.

Any number of retention clasps 23 in combination with retention edges 29 may be utilized as well as a number of varied removable retention mechanisms which allow removable affixation of the accessory ring 16 relative to the support ring 14. Such removable retention of the accessory ring 16 merely allows the accessory ring to be firmly secured to the support ring 14 or to the fixture housing when the support ring is combined with the remaining portion of the luminaire. Such varied removable retention mechanisms are considered to fall within the teaching hereof.

Figure 3:
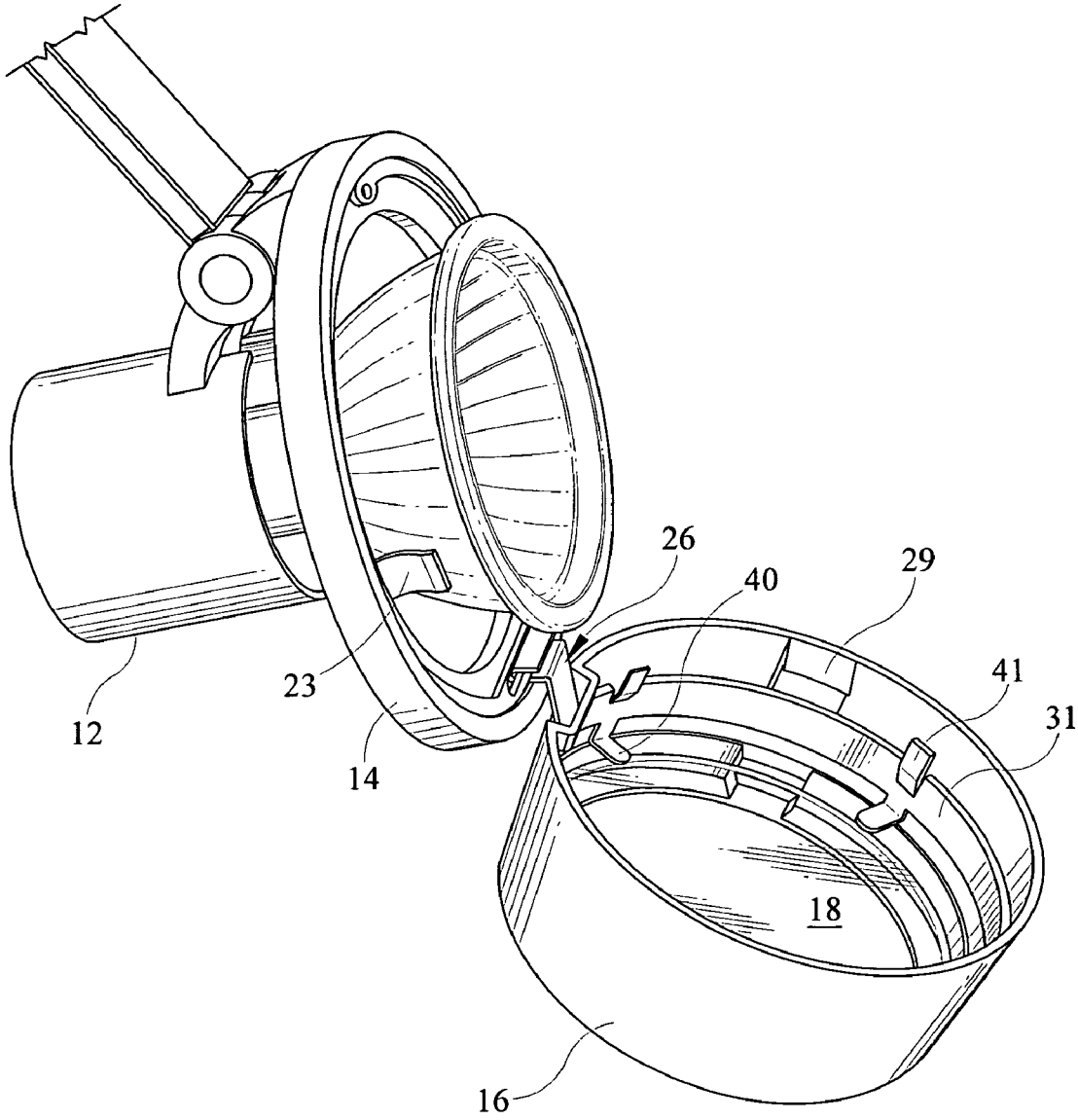
FIG. 3 is a perspective view of the track fixture with hinged accessory ring of the present invention with the accessory ring rotated about the hinge.
Figure 4:
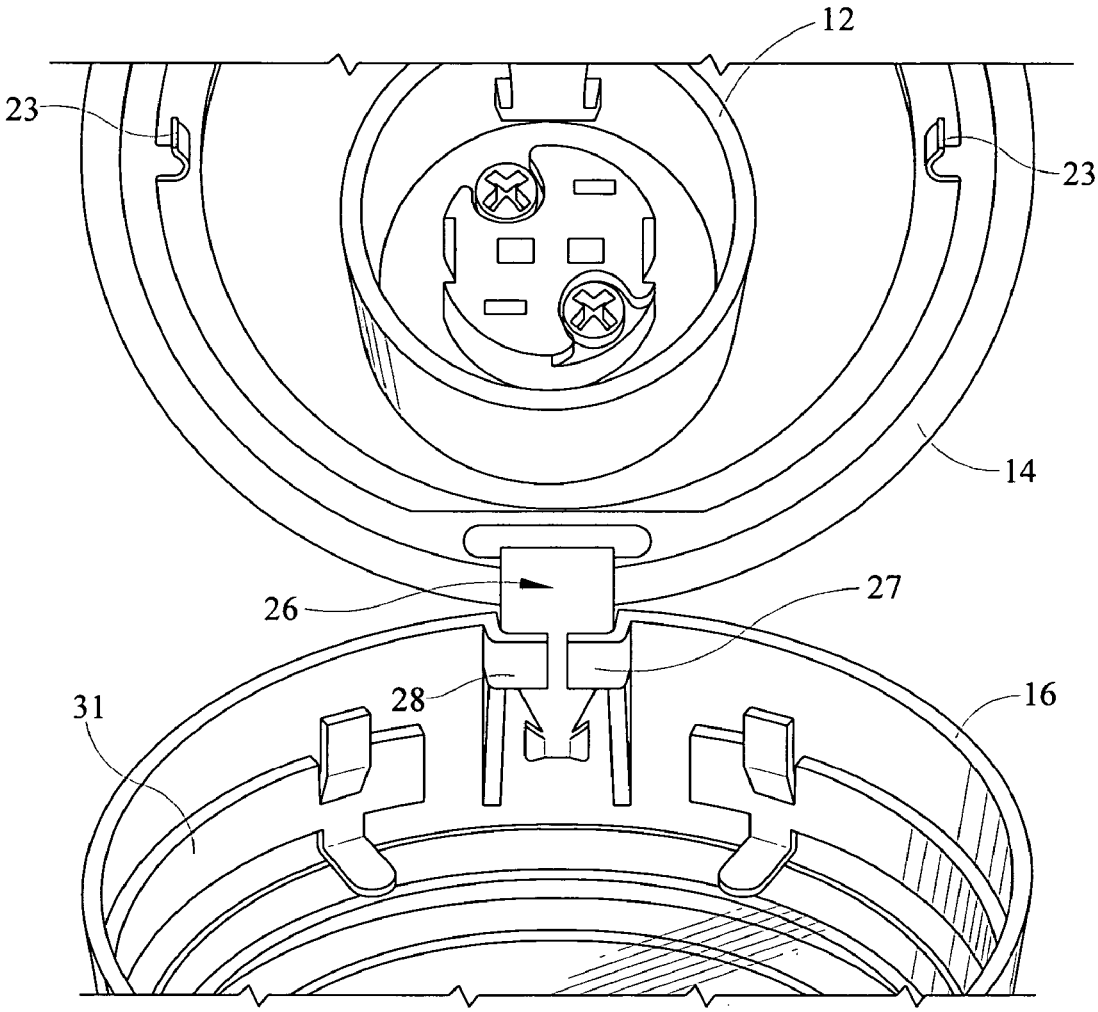
FIG. 4 is a close up view of the pull out hinge and fixture design of the present invention.

The retention spring 35 has, as previously described, a hinge pin 38 formed along a lower portion thereof which is captured within a hinge capture 39 of hinge 26. The hinge capture 39 merely encircles the hinge pin 38 while allowing rotational movement of the hinge 26 about the hinge pin 38 thereby further allowing accessory ring 16 to rotate about an axis defined by the hinge pin 38. The hinge 26 of the present invention is rotatably attached to the support ring 14 via the hinge capture 39 while also allowing outward sliding movement of the accessory ring 16 away from the support ring 14. The hinge 26, as is depicted in FIG. 5, has a flat hinge slide portion 34 which slides through first and second hinge capture arms 27, 28 which slideably retain the hinge 26 therein allowing such outward movement of the accessory ring 16 relative to the support ring 14. The outward movement of the accessory ring 16 along the hinge slide portion 34 allows the accessory ring 16 to move outward and away from the support ring 14 such that, when rotated about the hinge pin 38, the accessory ring 16 may easily clear the lamp which may protrude outwardly from the support ring 14, as is shown in FIG. 3. Such outward movement away from the support ring 14 by the accessory ring 16, allows the accessory ring to rotate about the hinge pin and be out of the way of the lamp for servicing of the lamp or other luminaire parts. As shown in FIG. 3, the accessory ring 16 has been pulled outward and away from the support ring 14 and rotated about the hinge pin while maintaining connectivity to the support ring 14. Thus, in the position depicted, the lamp may be readily removed without necessarily requiring complete removal of the accessory ring 16 and the accompanying lens or other parts.

The hinge 26, as is shown in FIG. 5, has the hinge slide portion 34 which allows such outward movement away from the support ring. Such outward movement from the support ring may be restricted by hinge stops 36, 37 which contact the hinge capture arms 27, 28 to prevent such outward movement and to allow the accessory ring 16 to hang and be fully supported on the support ring 14. As is shown in FIG. 5, the first and second hinge stops 36, 37 contact first and second hinge capture arms 27, 28 thereby preventing further outward movement while also fully supporting the accessory ring 16. As can be understood, the outward movement of the accessory ring 16 outward and away from the support ring 14 is defined by the length of the hinge slide portion 34 between the hinge capture 39 and the first and second hinge stops 36, 37 and less the width of the hinge capture arms 27, 28. Thus, outward movement should be provided allowing for the accessory ring 16 to be pulled outward and away from support ring 14 sufficiently to rotate and clear the outer edges of the lamp and any other hardware of the luminaire.

As is understood, various designs of the hinge 26 may be implemented which allows outward movement of the accessory ring 16 relative to the support ring. Such various designs are felt to be incorporated by the teachings hereof and may include not only hinge slide portions 34 as depicted with corresponding hinge stops 36, 37 but also cylindrical hinge members allowing sliding movement of the accessory ring 16 relative to the support ring 14. Hinge designs which incorporate both outward and rotational movement between the accessory ring 16 and the support ring 14 are deemed to fall within the teachings and claims hereof.

The hinge 26 of the present invention for utilization within the track luminaire 10 depicted is shown as being a non-integral member rotationally attached to the support ring 14 and slidable relative to the accessory ring 16. Such relative movement may be combined also such that a single hinge element may be rotational and slidable with respect to a single one of said accessory ring and/or said support ring. The use of the hinge 26 depicted allows for adequate outward movement in order to slide the accessory ring 16 outward and away from the lamp such that the accessory ring 16 may swing about the lamp for removal. The hinge design allows for both outward and rotational movement relative to the two rings while also preventing the necessity of complete removal of the accessory ring 16 from the luminaire 10 during change out of the lamp or other accessories and maintaining accessory set up.

Figure 6:
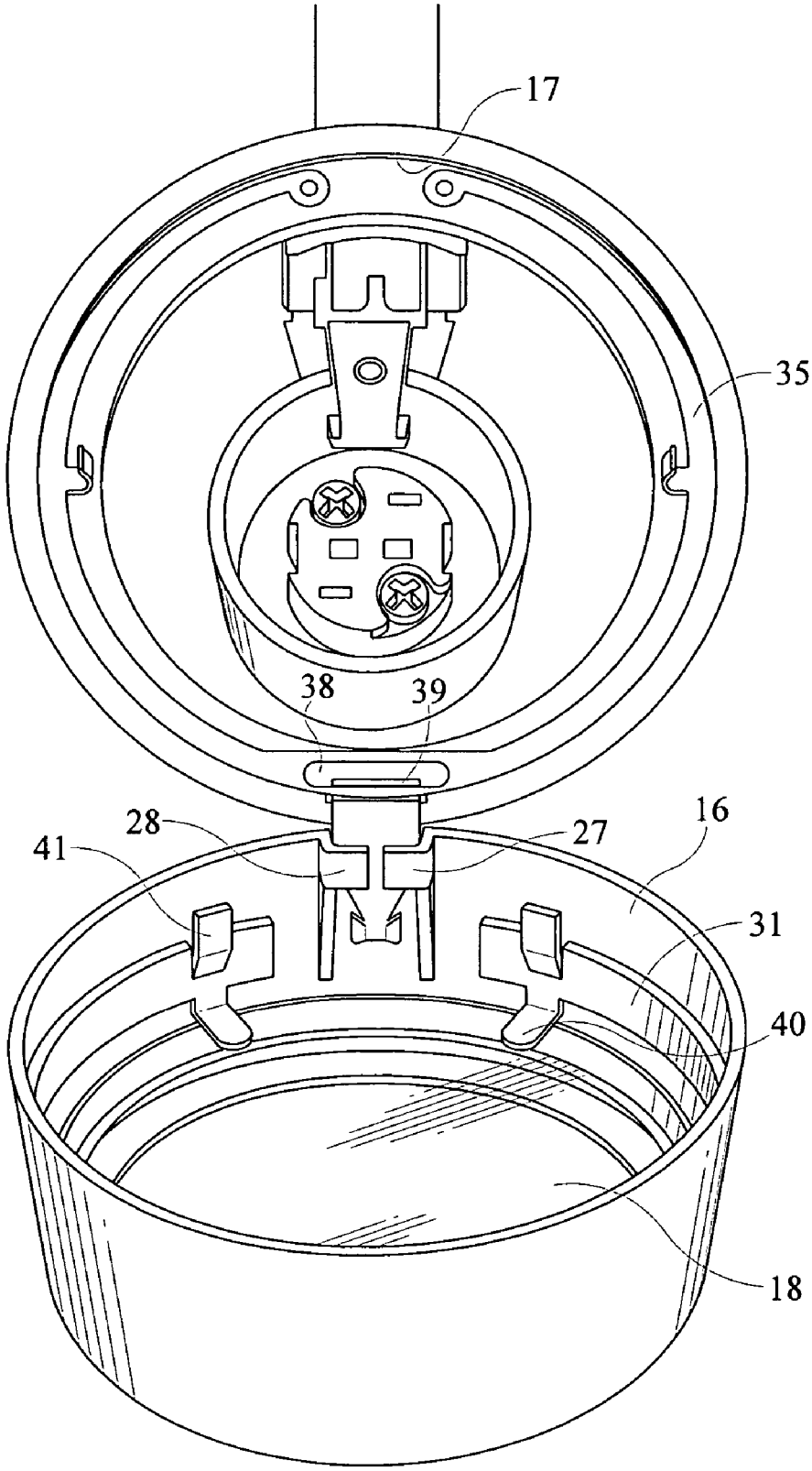
FIG. 6 is a frontal view of the track fixture with hinged accessory ring of the present invention with the accessory ring in the open position.

As depicted in FIG. 6 and in FIG. 3, the accessory ring 16 is in the open position allowing the lamp to be removed from the lamp socket cup 12 while also allowing for the lens 18 or other accessories to be modified within the accessory ring. As shown in FIG. 6, an accessory retention spring 31 may be inserted into the interior of the accessory ring 16 and may have a plurality of downwardly extending prongs or feet 40 to apply outward force or pressure on the lens 18 thus maintaining the lens in position. Additionally, the accessory retention spring may also be used to maintain in position filters or other accessories adjacent to the lens and which may be held in place between the prong 40 and upwardly extending prong 41. The accessory retention spring 31, as is shown in FIG. 6, may be a C-shaped spring which may be removable from the interior of the accessory ring such that is removably retained therein by inward biasing pressure of the C-shaped spring member 31.

As is depicted in FIG. 2, the two motion hinge design of the present invention allows an accessory ring to be moved outwardly relative to a track fixture luminaire support ring or housing while also allowing the accessory ring to rotate outward away from the housing and lamp and rotate about the lamp such that the accessory ring clears the lamp to be able to replace a lamp without disturbing the accessory set up. The accessory ring 16 fits snuggly around the support ring in order to achieve the smallest possible size of luminaire while maintaining the accessory ring in fixed position to the luminaire 10. The lamp utilizing the luminaire 10 of the present invention may be therefore replaced without removing the accessory or accessory ring thereby disturbing the potential design parameters of the accessories provided.

Various modifications to the embodiments depicted herein may be made without departing from the spirit and disclosure of the present invention. These modifications include changes made to the dual movement hinge design depicted herein as well as modifications to the track luminaire fixture design and accessory ring. Such modifications are deemed to fall within the teachings hereof when taking the teachings of the entire specification and drawings in combination as well as the appended claims.

The invention claimed is:

1. A track fixture with hinged accessory ring, comprising:

a track connector in electrical communication with a socket cup, the said socket cup affixed to a support ring;

a pull-out hinged accessory ring hingedly connected to said support ring;

wherein said hinge between said support ring and said pull-out hinged accessory ring allows for outward sliding movement; and wherein said hinge rotates about a hinge pin on said support ring.

2. The track fixture of claim 1 wherein said hinge has a slide section allowing said outward sliding movement.

3. The track fixture of claim 2 wherein said slide section is flat.

4. The track fixture of claim 3 wherein said slide section slidably extends through at least one hinge capture arm.

5. The track fixture of claim 4 wherein said at least one hinge capture arm is on said support ring.

6. The track fixture of claim 4 wherein said at least one hinge capture arm is a first and a second hinge capture arm on said pull-out hinged accessory ring.

7. The track fixture of claim 1 wherein said hinge has a hinge capture mechanism for rotatably receiving a hinge pin, a slide area and at least one stop adjacent said slide area to restrict said outward sliding movement.

8. A pull out hinged track luminaire, comprising:

a socket holder affixed to a track support arm;

a support ring connected to said socket holder;

an accessory ring hingedly connected to said support ring by a pull out hinge, said pull out hinge allowing outward and rotational movement;

wherein said pull out hinge has a flat section allowing said outward movement and a rotational hinge portion; and wherein said rotational hinge portion captures a hinge pin on a removable spring attached to said support ring.

9. The luminaire of claim 8 wherein said removable spring is a c-shaped spring removably captured in a channel along a periphery of said support ring.

10. The luminaire of claim 9 wherein said pull out hinge has a stop opposite said rotational hinge portion.

11. The luminaire of claim 10 wherein said accessory ring has a hinge capture for slidably capturing said flat section of said hinge.

12. The luminaire of claim 11 wherein said hinge capture is a first hinge capture arm and a second hinge capture arm, said stop on said hinge preventing said hinge from outward movement of said hinge through said hinge capture.

13. The luminaire of claim 8 wherein said accessory ring slides outward away from said support ring and rotates about said support ring.

14. An accessory ring for a track light fixture, comprising:

an accessory ring connected to a luminaire housing, a hinge interposed between said accessory ring and said luminaire housing, said luminaire housing having a lamp, said accessory ring positioned adjacent said lamp in order to affect the luminous characteristics of said lamp by retaining a lens in said accessory ring in close proximity to said lamp;

wherein said hinge between said accessory ring and said luminaire housing allows for movement outward and away from said housing while also allowing for rotational hinge movement relative between said accessory ring and said luminaire housing; and wherein said outward movement hinge has at least one stop restricting said outward movement.

15. A track luminaire having an outward movement hinge, comprising:

a track support arm connected to a socket holder and a support ring;

an accessory ring hingedly connected to said support ring, said accessory ring movable away from said support ring and rotationally about said support ring by said outward movement hinge;

wherein said outward movement hinge has a flat slide portion and a rotational hinge capture portion; and wherein said accessory ring has a slide capture for receiving said outward movement hinge, said hinge further having at least one stop.

16. The track luminaire of claim 15 wherein said rotational hinge capture portion is rotatable about a hinge pin on said support ring.

17. The track luminaire of claim 16 wherein said support ring has a removably affixed spring, said spring having said hinge pin.

18. The track luminaire of claim 17 wherein said spring is a c-shaped spring which is biased into a peripheral channel of said support ring.

19. An accessory ring for a track light fixture, comprising:

an accessory ring connected to a luminaire housing, a hinge interposed between said accessory ring and said luminaire housing, said luminaire housing having a lamp, said accessory ring positioned adjacent said lamp in order to affect the luminous characteristics of said lamp by retaining a lens in said accessory ring in close proximity to said lamp;

wherein said hinge between said accessory ring and said luminaire housing allows for movement outward and away from said housing while also allowing for rotational hinge movement relative between said accessory ring and said luminaire housing;

wherein said housing has a socket cup and a support ring; and wherein said socket cup and said support ring are separated by an arc shaped support arm.

20. The fixture of claim 19 wherein said hinge has a flat slide allowing said accessory ring to move outward and away from said housing.

21. The fixture of claim 20 further comprising a hinge pin structure allowing said rotational movement relative between said accessory ring and said luminaire housing.

* * * * *